United States Patent [19]

Bissinger et al.

[11] Patent Number: 4,977,945

[45] Date of Patent: Dec. 18, 1990

[54] FULL MOLD COMPRISED OF A PLASTIC FOAM MATERIAL

[75] Inventors: Fridolin Bissinger, Ludwigshafen; Erich Krzyzanowski, Frankenthal; Adalbert Wittmoser, Lampertheim, all of Fed. Rep. of Germany

[73] Assignee: Grunzweig and Hartmann und Glasfaser AG, Ludwigshafen, Fed. Rep. of Germany

[21] Appl. No.: 443,036

[22] Filed: Dec. 1, 1989

Related U.S. Application Data

[63] Continuation of Ser. No. 317,032, Mar. 1, 1989, abandoned, which is a continuation of Ser. No. 915,759, Oct. 6, 1986, abandoned.

[30] Foreign Application Priority Data

Oct. 5, 1985 [DE] Fed. Rep. of Germany ..... 3535603

[51] Int. Cl.[5] ..... B22C 7/02; B22C 9/04

[52] U.S. Cl. ..... 164/235; 164/34; 164/246

[58] Field of Search ..... 164/34, 235, 246, 35, 164/36, 45

[56] References Cited

U.S. PATENT DOCUMENTS

| | | | |
|---|---|---|---|
| 2,830,343 | 4/1958 | Shroyer | 164/34 |
| 3,498,365 | 3/1970 | Wittmoser | 164/246 X |
| 4,616,689 | 10/1986 | Denis | 164/34 |

FOREIGN PATENT DOCUMENTS

| | | | |
|---|---|---|---|
| 1079340 | 3/1984 | U.S.S.R. | 164/45 |
| 955021 | 4/1964 | United Kingdom | 164/34 |

OTHER PUBLICATIONS

"FULL MOULD CASTING PROCESS", Pressed Steel Company Limited, Cowley, Oxford.

"The Full Mold Casting Process for the production of steel casting", by Professor Dr. Wittmoser, in the Proceedings of 1972 Annual Conference, pp. 7:1–7:6.

*Primary Examiner*—Richard K. Seidel

*Assistant Examiner*—J. Reed Batten, Jr.

*Attorney, Agent, or Firm*—Oblon, Spivak, McClelland, Maier & Neustadt

[57] ABSTRACT

A full mold for casting contains a plastic foam material lost pattern. The plastic foam material is substantially sulfur-free and can advantageously be used to provide iron alloy-based full-mold cast pieces of high quality.

8 Claims, No Drawings

FULL MOLD COMPRISED OF A PLASTIC FOAM MATERIAL

This application is a continuation of application Ser. No. 317,032, filed on Mar. 1, 1989 which in turn is a continuation of Ser. No. 915,759 filed Oct. 6, 1986, both now abandoned.

BACKGROUND OF THE INVENTION

1. Field of the Invention

The invention relates to a full mold for manufacturing cast pieces by the full mold casting method.

2. Discussion of the Background

Cast pieces made of ferrous or nonferrous metal alloys can be made with so-called full molds. Full molds are molds containing a plastic foam material lost pattern which decomposes with practically no residue. During the adding operation, the plastic foam material lost pattern decomposes, and the molten metal fills the resulting cavity and solidifies there to yield the desired cast piece.

It has been found, particularly in industrial fabrication of full-mold cast pieces of this type, that it is more difficult to obtain uniform quality cast pieces with full mold casting than with ordinary hollow mold casting. Thus, full-mold cast pieces made from iron alloys initially have unexplained defects. These defects are primarily local, and would not be expected to arise under the production conditions employed. For example, with full-mold cast pieces made of cast iron with spherical graphite, defects in the structure of the spherical graphite develop even though the melt contains sufficient magnesium and is low in sulfur (as is metallurgically required). At the loci of these defects, which are local, there is diminished strength and elasticity.

Also, in the case of full-mold cast pieces with vermicular graphite, one finds that at certain locations in the cast pieces the desired form of graphite fails to develop, so that locally only lamellar graphite is present in the grain structure. The result is a diminishing of the desired properties of the material.

Further, in the case of full-mold cast pieces made of cast iron with lamellar graphite, difficultly machinable spots (hard spots) develop at nonpredeterminable locations.

In studies which have been made on full-mold cast pieces made of steel casting alloys, it has been found that these also have multiple locally limited defect locations. Such defects do not arise when the same alloys are cast in ordinary hollow molds. The defect locations involved here show so-called heat-cracks and hardness spots which are different from the kinds of defects found with cast iron alloys.

The first and obvious approach was to look for the source of the defect phenomena in a partial (incomplete) gasification of the mold material, which can lead to so-called "residues" when the technique of full-mold casting is incorrectly carried out. However, it was already known for a fairly long time, that such "residues" are comprised of carbon (carbon black and lustrous carbon), which tends to prevent hard spots rather than create them, at least in the case of graphite-containing cast iron alloys.

Accordingly, there is a strongly felt need in the art of making and using full-molds, and in making cast pieces made of iron alloys for a process and/or mold which would not suffer from the difficulties outlined above.

SUMMARY OF THE INVENTION

Accordingly, it is an object of this invention to provide a full mold for manufacturing cast pieces by the full mold casting method, which provides cast pieces having a uniform quality.

It is another object of this invention to provide a full mold for use in the full mold casting method, which eliminates unexplained defects in the full-mold cast pieces made from ferrous or non-ferrous alloys.

It is another object of this invention to provide a full mold for use in the full mold casting method which can be used to provide full-mold cast pieces having nodular graphite in which the vermicular graphite is well developed.

It is another object of this invention to provide a full mold for use in the full mold casting method which can be used to produce full-mold cast pieces made of cast iron with nodular graphite, where the full-mold cast pieces do not appreciably possess difficulty machinable spots at non-predeterminable locations.

It is another object of this invention to provide a full mold for use in the full mold casting method, which can be used to provide full-mold cast pieces made of steel casting alloys, where the steel casting alloys produced do not suffer from multiple locally limited defect locations.

It is another object of this invention to provide a full mold for use in the full mold casting method which can be used to produce full-mold cast pieces made of steel casting alloys which do not suffer from heat and hardness cracks.

The inventors have now surprisingly discovered a new full mold for casting which satisfies all of the objects of this invention outlined above, and other objects which will become obvious from a reading of the description of the invention given hereinbelow. The full mold for casting of this invention comprises a plastic foam material lost pattern, preferably expanded polystyrene. It is characterized in that the lost pattern is made of a substantially sulfur-free plastic foam material.

DETAILED DESCRIPTION OF THE PREFERRED EMBODIMENTS

The underlying problem the invention solves is to substantially improve full-mold cast pieces made of iron alloys, such that the pieces have uniform structure, i.e. such that the above-described locally limited defect phenomena are absent.

Particularly when casting in serial production with full molds comprised of expanded polystyrene using the full-mold casting method, it has been found that the full-mold cast pieces obtained, when comprised of iron alloys, have isolated, primarily local defect loci comprising, e.g., alteration of the form of the graphite, or formation of hard grain structure locations. Also, heat cracks and hardness spots have been observed in widely differing iron alloys. In an effort to eliminate this wide variety of local defect phenomena, it was discovered in this invention that the common source of the defects lies in an excessive sulfur content in the lost patterns. Therefore, according to the invention a lost pattern comprised of plastic foam material is provided. The plastic foam material comprises a substantially sulfur-free plastic foam, where the sulfur content of such material is $<1$ wt% preferably less than 0.1 wt.%.

The problems found in the prior art are solved by the present invention by using a plastic foam material, which preferably comprises expanded polystyrene, for the lost pattern for manufacturing cast pieces by the full-mold casting method. The foam material used is sulfur-free. Based on extensive experimentation, it has been discovered, surprisingly, that the cause of all the various defect phenomena in the different iron alloys lies in the use of lost patterns comprised of plastic foam with excessive sulfur contents- (up to 1.6 wt.% or more).

When a sulfur-free plastic foam material is used for the lost pattern, the defect phenomena of concern no longer appear in full-mold cast pieces comprised of iron alloys. In order to achieve this goal, it is sufficient to use a plastic foam material in which the sulfur content of the plastic foam is $\leqq 0.1$ wt.%, preferably $<0.1$ wt.%.

It is also advantageous to use a lost pattern in which the substantially sulfur-free plastic foam is halogen-free as well (i.e. fluorine, chlorine, bromine or iodine). The absence of halogens increases the gasifiability of the lost pattern, and halogens which are liberated can be deleterious to the environment.

Finally, the gasification of a low-sulfur mold can be further promoted (in a manner which is itself known) if the mold contains an agent which promotes absorption of heat irradiated from the melt (where the melt displaces the mold material in the casting process). A suitable such agent is an organic dye or pigment, which may be preferably finely distributed in the plastic foam. Reference is made to German Pat. No. 1,234,937 which discloses organic dyes or pigments which can be thus used, German Pat. No. 1,234,937 being hereby expressly incorporated herein by reference.

In this connection, it is in fact known to use, among other things, sulfur, to achieve a uniform, wear-resistant grain structure in full-mold cast pieces, with the sulfur being added in the material which is being cast (German OS 14 33 918) or in the plastic foam lost pattern (German Pat. No. 1,144,882). However, there is no indication in these publications which might suggest to one skilled in the foundry art that there is a common cause for all the various locally occurring defects of widely varying types which appear in the various iron alloys—defects such as alteration of the form of the graphite, formation of loci of hard grain structure, and the formation of heat-cracks and hardness-spots.

The iron alloys usable in this invention and with which the superior results of the present invention are observed, are well known.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a full mold for casting products, the improvement comprising a lost pattern comprised of a plastic foam material which is substantially sulfur-free.

2. The full mold of claim 1, wherein the said lost pattern of plastic foam material comprises expanded polystyrene.

3. The full mold of claim 1, wherein the sulfur content of the said lost pattern of plastic foam material is less than 0.1 wt.%.

4. The full mold of claim 1, wherein the said lost pattern of plastic foam material is free of halogens.

5. The full mold of claim 1, wherein the said lost pattern of plastic foam material comprises polystyrene, the sulfur content of the said plastic foam material is less than 0.1 wt.%, and the said plastic foam material is free of halogens.

6. The full mold of claim 1, wherein the said lost pattern of plastic foam material contains an agent which promotes absorption of heat irradiated by a melt added to the full mold.

7. The full mold of claim 6, wherein the agent which promotes absorption of the irradiated heat comprises an organic dye or pigment.

8. The full mold of claim 7, wherein the said organic dye or pigment is finely dispersed in the said plastic foam material.

* * * * *